US007311591B2

(12) United States Patent
Stubbs

(10) Patent No.: US 7,311,591 B2
(45) Date of Patent: Dec. 25, 2007

(54) ABRASIVE MATERIALS

(75) Inventor: Roy Stubbs, Nuneaton (GB)

(73) Assignee: 3M Innovative Properties Company, St. Paul, MN (US)

( * ) Notice: Subject to any disclaimer, the term of this patent is extended or adjusted under 35 U.S.C. 154(b) by 341 days.

(21) Appl. No.: 10/625,353

(22) Filed: Jul. 23, 2003

(65) Prior Publication Data

US 2005/0059329 A1 Mar. 17, 2005

Related U.S. Application Data

(63) Continuation-in-part of application No. 08/540,674, filed on Oct. 11, 1995, now abandoned.

(30) Foreign Application Priority Data

Oct. 11, 1994 (GB) ..... 94.20509

(51) Int. Cl.
*B24D 11/00* (2006.01)

(52) U.S. Cl. ..... 451/538; 451/523; 451/524; 451/539

(58) Field of Classification Search ..... 451/523, 451/524, 533, 538, 539, 530
See application file for complete search history.

(56) References Cited

U.S. PATENT DOCUMENTS

| | | | | |
|---|---|---|---|---|
| 2,780,533 | A * | 2/1957 | Hurst | 51/297 |
| 3,607,159 | A | 9/1971 | Haywood | |
| 4,038,047 | A | 7/1977 | Haywood | |
| 4,202,139 | A | 5/1980 | Hong et al. | |
| 4,263,755 | A | 4/1981 | Globus | |
| 4,593,427 | A | 6/1986 | Ortolivo | |
| 4,621,388 | A | 11/1986 | Ortolivo | |
| 4,629,473 | A | 12/1986 | Ruid et al. | |
| 4,962,562 | A | 10/1990 | Englund et al. | |
| 4,966,609 | A | 10/1990 | Callinan et al. | |
| 5,054,248 | A | 10/1991 | Thayer | |
| 5,123,139 | A | 6/1992 | Leppert et al. | |
| 5,127,976 | A | 7/1992 | McLeish et al. | |
| 5,170,595 | A | 12/1992 | Wiand | |
| 5,220,752 | A | 6/1993 | Cheney et al. | |
| 5,222,331 | A | 6/1993 | Manor et al. | |
| 5,309,681 | A | 5/1994 | Cheney et al. | |

FOREIGN PATENT DOCUMENTS

| | | |
|---|---|---|
| CH | 650 441 A5 | 7/1985 |
| DE | 39 03 204 A1 | 2/1990 |
| DE | G 94 07 622.7 | 8/1994 |
| EP | 0 112 405 A1 | 7/1984 |
| EP | 0 578 865 A1 | 1/1994 |

(Continued)

OTHER PUBLICATIONS 3M product brochure entitled "Softback Sanding Sponges;" 3M, St. Paul, Minnesota; 1 pg. (1993).

(Continued)

*Primary Examiner*—Eileen P. Morgan
(74) *Attorney, Agent, or Firm*—David B. Patchett

(57) ABSTRACT

A direct-coated sponge abrasive material bearing a releasable securing means comprising one part of a two part hook and loop attachment system is provided.

11 Claims, 1 Drawing Sheet

FOREIGN PATENT DOCUMENTS

| | | |
|---|---|---|
| FR | 1 411 309 | 8/1964 |
| GB | 1 328 292 | 8/1973 |
| GB | 1 472 087 | 4/1977 |
| GB | 1 597 455 | 9/1981 |
| GB | 2 113 977 A | 8/1983 |
| GB | 2 143 720 A | 2/1985 |
| GB | 2 260 889 A | 5/1993 |
| GB | 2 282 144 A | 3/1995 |
| WO | WO 86/01090 | 2/1986 |
| WO | WO 87/04061 | 7/1987 |

OTHER PUBLICATIONS 3M product brochure entitled "New abrasive pads for easy sanding of awkward areas;" 3M, Berks, United Kingdom; 2 pgs. (Dec. 1992).

* cited by examiner

ABRASIVE MATERIALS

RELATED APPLICATIONS

This application is a continuation-in-part of U.S. patent application Ser. No. 08/540,674, filed Oct. 11, 1995 now abandoned which claimed priority from United Kingdom Patent Application No. 94 205 09, filed Oct. 11, 1994. This application also claims priority from UK Patent Application No. 94 205 09, filed Oct. 11, 1994.

FIELD OF THE INVENTION

This invention relates to abrasive materials and in particular to direct-coated sponge abrasive materials.

BACKGROUND

"Direct-coated" sponge abrasives are materials in which abrasive mineral is coated on the surface of a resilient, cellular (sponge) material, such as foamed plastic, together with the relevant adhesives and binders. Although one or more resin layers may be coated on the foam prior to coating the abrasive, it is the foam itself which provides the overall structural integrity of the finished article, and largely determines its bulk physical properties such as tensile strength.

"Laminated sponge" abrasives are materials in which a conventional substrate, such as paper, cloth, etc. is coated on one side with abrasive grains and laminated by the other side to a sponge backing. Such laminated sponge abrasive materials are disclosed in DE 39 03 204; U.S. Pat. No. 4,263,755; and EP 0 578 865; and exemplified by the product sold under the tradename "SIASOFT" by SIA. Although the presence of the sponge layer confers useful properties such as resilience and insulation, the overall properties are determined to a significant extent by the substrate on which the abrasive is actually coated.

Direct-coated sponge abrasives show several advantages over their laminated sponge counterparts, including reduced raw material costs and an improved performance in terms of the smoothness of finish for a given rate of cut. Direct-coating of abrasive on to sponge materials is disclosed in various patents, e.g. U.S. Pat. Nos. 4,966,609; 4,629,473; 4,038,047; and 3,607,159; and UK Patent Nos. 1 597 455 and 1 472 087. Commercially available direct-coated sponge abrasive products are sold by 3M Company under the product numbers 03808, 03809 and 03810.

Such direct-coated sponge abrasives are generally intended for hand sanding where they are grasped by the user and rubbed against the workpiece with a suitable application of pressure. Thus, the user's hand and arm must supply a gripping action, a pressing action and a push-pull action, with the gripping action in particular potentially imposing strain and fatigue on the muscles and joints of the fingers when sanding is carried out over extended periods of time.

A variety of materials have been laminated to the reverse (non-abrasive coated) side of direct-coated sponge abrasive articles.

U.S. Pat. No. 4,966,609 discloses the use of a textile reinforcement (which may be any knit, woven or non-woven fabric) to provide increased strength and restrict extensibility. U.S. Pat. Nos. 4,629,473; 4,038,047; and 3,607,159 all disclose direct-coated sponge abrasive laminated to a backing member. The backing members include cloth, paper, plastic film, etc., and the backing member apparently contributes most of the mechanical strength of the finished article. UK Patent No. 1 472 087 discloses a foam pad having a coating of abrasive on one side and a coating of adhesive on the reverse. The adhesive enables the pad to be fixed to a suitable surface so that surgical tools or other implements may be cleaned by rubbing against the abrasive coating.

Hook and loop attachment systems are known and have been used for the attachment of abrasive articles to back-up pads, including the attachment of laminated sponge abrasive articles, as disclosed in EP 0 578 865 and DE 39 03 204. Hook and loop systems have also been used for the attachment on non-abrasive-coated foam buffing pads, as disclosed in U.S. Pat. Nos. 5,123,139 and 4,962,562.

U.S. Pat. No. 4,263,755 discloses a laminated sponge abrasive article in which the sponge layer itself functions as part of a hook and loop attachment system. This places severe restrictions on the type of sponge material that can be used, as only very open-textured materials give adequate engagement with the hooks or other protuberances on the back-up pad. Such materials do not function well as the self-supporting backing for a coated abrasive layer.

Various patents, e.g., UK 2 113 977; WO 87/04061; and WO 86/01090, disclose articles in the form of a glove having abrasive and/or cleaning elements releasably attached thereto. The hook and loop attachment system sold under the trade designation "VELCRO" attachment system is suggested as a possible attachment means, and the cleaning/abrading elements may comprise cellular materials.

It is known to use a strap or similar device to secure a sanding pad or block to a user's hand, the pad or block being releasably attached to an abrasive sheet, e.g., U.S. Pat. Nos. 5,222,331 and 4,202,139 and the hand sanding pad sold under the trade designation "EASYGRIP" hand sanding pad supplied by NicSand Inc. of Cleveland, Ohio.

The present invention provides direct-coated sponge abrasive materials adapted for being releasably secured to a hand strap, back-up pad, etc.

SUMMARY

According to the present invention, there is provided a direct-coated sponge abrasive material directly bearing a releasable securing means comprising one part of a two part hook material and loop material attachment system.

The term "direct-coated sponge abrasive material" is intended to include materials in which abrasive material is coated on the surface of a resilient, cellular sponge material together with relevant binders and to exclude sponge materials that are impregnated throughout with abrasive particles. That is, a direct coated abrasive sponge has only a surface coating of abrasive material.

The invention provides direct-coated sponge abrasive materials which may be used in combination with a strap, back-up pad, block, handle, etc. bearing the other half of the hook and loop attachment system. The resulting products retain the outstanding performance of direct-coated abrasive sponges and possess one or more of the advantages of convenience, simplicity to use and reduction in strain and fatigue during hand sanding. The invention allows the sponge abrasive material to be secured flat against the user's palm so that the gripping action is largely eliminated, thereby reducing strain on the hand.

DETAILED DESCRIPTION

Figure 1:
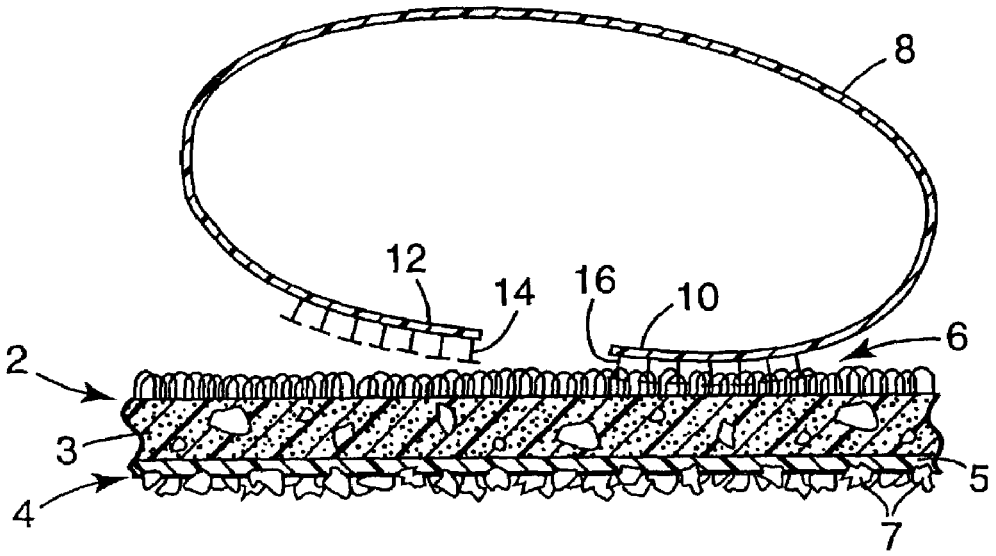
FIG. 1 is a cross-sectional view of one embodiment of an article of the invention.

In FIG. 1, abrasive material 2 comprises a sponge sheet 3 having a direct coated abrasive layer 4 comprised of adhesive layer 5 and abrasive particles 7 and one part of a hook and loop fastening system 6. A strap 8 deployed in a loop has respective ends 10 and 12 bearing respective complementary portions 14 and 16 of the fastening system to allow the respective ends 10 and 12 to be secured to the abrasive material.

Figure 2:
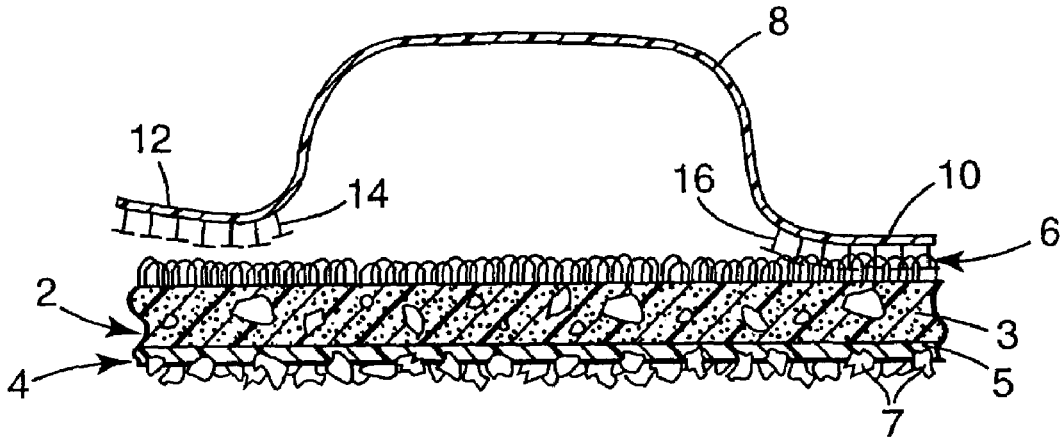
FIG. 2 is a cross-sectional view of another embodiment of an article of the invention.

In FIG. 2, the same elements as shown in FIG. 1 are shown, except strap 8 is deployed in more of a "u" shape.

In one embodiment of the invention, a layer of loop material is secured to the sponge surface and enables temporary attachment to a layer of hook material which forms part of a handle, hand strap, back-up pad, etc.

In an alternative embodiment, a layer of hook material is secured to the sponge surface to enable attachment to a layer of loop material which forms part of a handle, hand-strap, back-up pad, etc.

Loop materials suitable for use in the invention include brushed nylon, such as the material sold under the trade designation "VELL STRAPP RESINATO" by Sitip SpA of Italy, and other commercially available materials such as those supplied under the trade designations "KANEBO 2A3," "KANEBO 2K3," "VELCRO," etc.

Hook materials suitable for use in the invention have a multiplicity of hook-shaped or burr-like protuberances capable of engaging the loops of the loop material, and are available commercially under the trade designations "VELCRO," "KANEBO," etc.

The loop material or hook material may be secured to the sponge surface by any conventional means, such as flame lamination or adhesive, especially a hot melt adhesive. Suitable hot melt adhesives under the trade designation "SHARNET 4200," are available from Sharnet Corp., Ward Hill, Mass. Alternatively, a pressure-sensitive adhesive may be used.

Abrasive articles in accordance with the invention comprise a sponge substrate bearing on at least one surface thereof a coating of abrasive particles and on at least one other surface thereof a layer of hook or loop material. The layer of hook or loop material may extend over the entire area of the surface(s) to which it is secured, or may extend over only part of the surface(s). The substrate may comprise any sponge material suitable for use as an abrasive backing, including both open-cell and closed-cell materials, such as those disclosed in U.S. Pat. Nos. 4,966,609; 4,629,473; 4,038,047; and 3,607,159; and UK Patent Nos. 1 597 455 and 1 472 087. Abrasive particles are coated on at least one surface of the substrate by any conventional method, such as the methods disclosed in the aforementioned US and UK patents, but a particularly suitable method employs a moisture-curable hot melt adhesive as the make adhesive, as disclosed in UK Patent Application No. 9316715.3

In a particularly preferred embodiment of the invention, the substrate comprises a sheet of open-cell polyester-urethane foam having a density of about 50 to 100 kg/m$^3$ and a thickness of about 2 to 15 mm coated with abrasive particles on one major surface, the other major surface being bonded to a layer of hook or loop material, which preferably extends over the entire area of said other major surface. In this embodiment, the abrasive materials may be releasably attached to the back-up pad of a machine sander where back-up pad is equipped with the complementary half of the hook and loop attachment system. This enables the outstanding performance of direct-coated sponge abrasives to be realized in machine sanding operations such as rotary or random orbital sanding. The back-up pads and abrasive materials may have any desired shape, e.g., circular, rectangular, etc.

In this embodiment, abrasive materials of the invention, in the form of an elongate strip, may also be used to form an abrasive belt by attachment to a backing belt bearing the appropriate part of the hook and loop attachment system.

Abrasive materials in accordance with this embodiment of the invention are equally suited to hand sanding applications. For example, they may be releasably attached to a block or hand pad having an attachment surface equipped with the appropriate part of the hook and loop attachment system. The block or hand pad may be made of any of the conventional materials (wood, plastic, rubber, etc.) and is preferably molded or otherwise shaped so as to be grasped comfortably by the user, and/or is equipped with a strap with which to secure it to the user's hand.

Alternatively, the invention enables a hand-securing strap to be attached directly to the abrasive material. To this end, the strap comprises an elongate strip of material, e.g. about 50 mm wide and about 200 mm long having on at least the end portions of one of its surfaces the part of a hook and loop attachment system that is complementary to that present on the abrasive material of the invention. The strap may comprise any suitable material such as rubber, plastic film or textiles (woven or nonwoven). Elasticated or otherwise resilient materials may be used advantageously. At least the end portions of one of the surfaces of the strip are equipped with one half of the hook and loop attachment system. Preferably, an area of at least 500 mm$^2$ (more preferably at least 1000 mm$^2$) at each end is so equipped. Optionally, the entire surface may be so equipped. By attaching the ends of the strip to the abrasive material, it is possible to form a loop which accommodates the user's hand.

Two possible modes of attaching the ends are shown in FIGS. 1 and 2 of the accompanying drawings which represent diagrammatic cross-sections through the abrasive material and strap. The strap secures the abrasive material firmly to the user's hand and, thus, obviates the need for any gripping action on the part of the user during the sanding operation, which greatly reduces the fatigue suffered. The strap can, of course, be detached and repositioned at will to accommodate the different needs of different users.

In the case of direct attachment of a hand-securing strap as described above, it is unnecessary for the entire surface of the abrasive material to be equipped with hook or loop material. For example, a central strip would normally be all that is required, thus saving on the cost of raw materials, although this may be outweighed by other considerations, such as the desirability of generating products for a wide range of end uses from a single manufacturing operation.

The arrangement shown in FIGS. 1 and 2 readily allow the strap (8) to be adjusted to the dimensions of the user's hand. The embodiment of FIG. 1 is preferred since the pressure of the user's hand assists in closing the fastening system.

In another preferred embodiment of the invention, the abrasive material comprises a foam block (e.g., of about 25 mm thickness and square or rectangular in shape) having one pair of parallel opposed major surfaces, and two pairs of parallel opposed minor surfaces. At least one, but preferably both, of the major surfaces are coated with abrasive particles, and preferably one pair of parallel opposed minor surfaces are also coated with abrasive particles. Different grades of abrasive particles may be coated on different surfaces. Such abrasive materials are known, and are disclosed, for example, in UK Patent No. 1 328 292. In accordance with the present invention, two parallel opposed minor surfaces not having a coating of abrasive particles are each equipped with one part of a hook and loop attachment system. This enables the temporary attachment of a hand strap of the type described above, which may be used to secure the sanding block to the user's hand and hence reduce or eliminate the gripping action required.

Various modifications and alterations of this invention will become apparent to those skilled in the art without departing from the scope of this invention, and it should be understood that this invention is not to be unduly limited to the illustrated embodiments set forth herein.

What is claimed is:

1. An abrading system comprising:

a direct-coated sponge abrasive material directly bearing a releasable securing means comprising one part of a two part hook material and loop material attachment system wherein the abrasive layer comprises a coating on the surface of the sponge material together with binders which include abrasive material; and an elongate strap suitable for accommodating a hand, wherein the strap defines a first end and a second end opposite the first end, wherein the strap bears, at least at the first and second ends, the other part of the hook material or loop material of the attachment system, and further wherein the first and second ends of the strap are secured to the releasable securing means.

2. A direct-coated sponge abrasive material as claimed in claim 1 in which said releasable securing means comprises loop material secured to the sponge.

3. A direct-coated sponge abrasive material as claimed in claim 1 in which said releasable securing means comprises hook material secured to the sponge.

4. A direct-coated sponge abrasive material as claimed in claim 1 in which the sponge is in the form of a sheet having opposite major surfaces and the abrasive and securing means are on the opposite major surfaces.

5. A direct-coated sponge abrasive material as claimed in claim 1 in which the loop material comprises brushed nylon.

6. A direct-coated sponge abrasive material as claimed in claim 1, in which the sponge material comprises a sheet of open-cell polyester-urethane foam.

7. A direct-coated sponge abrasive material as claimed in claim 1, in which the sponge material has a density of about 50 $kg/m^3$ to 100 $kg/m^3$.

8. A direct-coated sponge abrasive material as claimed in claim 1, in which the sponge material is a sheet of foam material free of abrasive particles.

9. An abrading system comprising:

a direct-coated sponge abrasive material directly bearing a releasable securing means bonded onto a surface of the direct-coated sponge abrasive material, the releasable securing means comprising one part of a two part hook material and loop material attachment system, wherein the abrasive layer comprises a coating on the surface of the sponge material together with binders which include abrasive material; and a back-up pad comprising the other part of a hook material and loop material attachment system.

10. A direct-coated material as claimed in claim 9 in which the back-up pad is adapted for use on a motor driven sanding machine.

11. A direct-coated sponge abrasive material as claimed in claim 9 in which the back-up pad is in the form of a block for hand sanding.

* * * * *